US007526900B2

(12) United States Patent
Ehrman et al.

(10) Patent No.: US 7,526,900 B2
(45) Date of Patent: May 5, 2009

(54) MASONRY CAVITY WALL HAVING A COMPRESSIBLE, EXPANDABLE DEBRIS BLOCKER

(75) Inventors: Geoffrey N. Ehrman, Doylestown, PA (US); Michael S. Coulton, North Wales, PA (US); Nathan L. Randello, Bensalem, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 458 days.

(21) Appl. No.: 11/274,685

(22) Filed: Nov. 15, 2005

(65) Prior Publication Data

US 2006/0117687 A1 Jun. 8, 2006

Related U.S. Application Data

(60) Provisional application No. 60/630,390, filed on Nov. 23, 2004.

(51) Int. Cl.
*E04B 1/70* (2006.01)
*E04B 2/28* (2006.01)

(52) U.S. Cl. ..... 52/302.3; 52/169.5

(58) Field of Classification Search ..... 52/169.14, 52/302.4, 293.3, 293.2, 379, 378, 383, 274, 52/566, 567, 302.3, 169.5
See application file for complete search history.

(56) References Cited

U.S. PATENT DOCUMENTS

| | | | | | |
|---|---|---|---|---|---|
| 4,178,715 | A * | 12/1979 | Greenbaum | 47/48.5 |
| 4,331,542 | A * | 5/1982 | Emrie | 210/794 |
| 4,381,630 | A * | 5/1983 | Koester | 52/169.5 |
| 4,852,320 | A * | 8/1989 | Ballantyne | 52/302.3 |
| 5,230,189 | A | 7/1993 | Sourlis | 52/169.5 |
| 5,284,027 | A * | 2/1994 | Martin, Sr. | 62/291 |
| 5,343,661 | A * | 9/1994 | Sourlis | 52/169.5 |
| 5,598,673 | A | 2/1997 | Atkins | 52/302.1 |
| 5,692,348 | A | 12/1997 | Ambrosino | 52/169.5 |
| 5,713,696 | A * | 2/1998 | Horvath et al. | 405/45 |
| 5,860,259 | A | 1/1999 | Laska | 52/302.3 |
| 5,937,594 | A * | 8/1999 | Sourlis | 52/169.5 |
| 6,023,892 | A | 2/2000 | Sourlis | 52/169.5 |
| RE36,676 | E | 5/2000 | Sourlis | 52/169.5 |
| 6,105,323 | A * | 8/2000 | Paulle | 52/302.1 |
| 6,112,476 | A * | 9/2000 | Schulenburg | 52/169.5 |
| 6,202,366 | B1 * | 3/2001 | Snyder et al. | 52/97 |
| 6,256,955 | B1 | 7/2001 | Lolley et al. | 52/302.3 |
| 6,684,579 | B2 | 2/2004 | Brunson et al. | 52/169.5 |
| 6,688,059 | B1 * | 2/2004 | Walker | 52/302.3 |
| 6,883,284 | B1 | 4/2005 | Burgunder et al. | 52/302.1 |
| 6,912,820 | B2 * | 7/2005 | Sourlis | 52/302.1 |
| 6,990,775 | B2 * | 1/2006 | Koester | 52/302.1 |

(Continued)

*Primary Examiner*—Gay Ann Spahn
(74) *Attorney, Agent, or Firm*—Howson & Howson LLP

(57) ABSTRACT

A mortar and debris collection device for use within a cavity wall to prevent the blockage of weep holes at the base of the wall. The cavity wall assembly includes a masonry wall, an adjacent inner wall, a wall cavity therebetween, and a free-standing elongate strip of openwork material located within the cavity forming a debris collection surface a spaced distance above a base surface of the cavity. Preferably, the openwork material is inserted and positioned within the cavity after the inner wall and only a base portion of the outer masonry wall is constructed. Thereafter, the upper portion of the outer masonry wall is constructed and any mortar or debris falling into the cavity is caught and supported on the debris collection surface.

4 Claims, 5 Drawing Sheets

U.S. PATENT DOCUMENTS

| | | | | |
|---|---|---|---|---|
| 7,216,460 | B2 * | 5/2007 | Sourlis | 52/169.5 |
| 7,380,374 | B1 * | 6/2008 | Pratt | 52/169.5 |
| 7,386,956 | B2 * | 6/2008 | Argila | 52/169.5 |
| 2002/0174954 | A1 * | 11/2002 | Busseuil et al. | 156/349 |
| 2003/0037499 | A1 * | 2/2003 | Coulton | 52/302.3 |
| 2003/0230035 | A1 | 12/2003 | Collins et al. | 52/209 |
| 2004/0003558 | A1 | 1/2004 | Collins et al. | 52/302.1 |
| 2004/0035069 | A1 * | 2/2004 | Jackson | 52/302.1 |
| 2004/0055245 | A1 * | 3/2004 | Fitch | 52/716.8 |
| 2004/0231259 | A1 * | 11/2004 | Sourlis | 52/302.1 |
| 2005/0138876 | A1 * | 6/2005 | Sourlis | 52/302.1 |

* cited by examiner

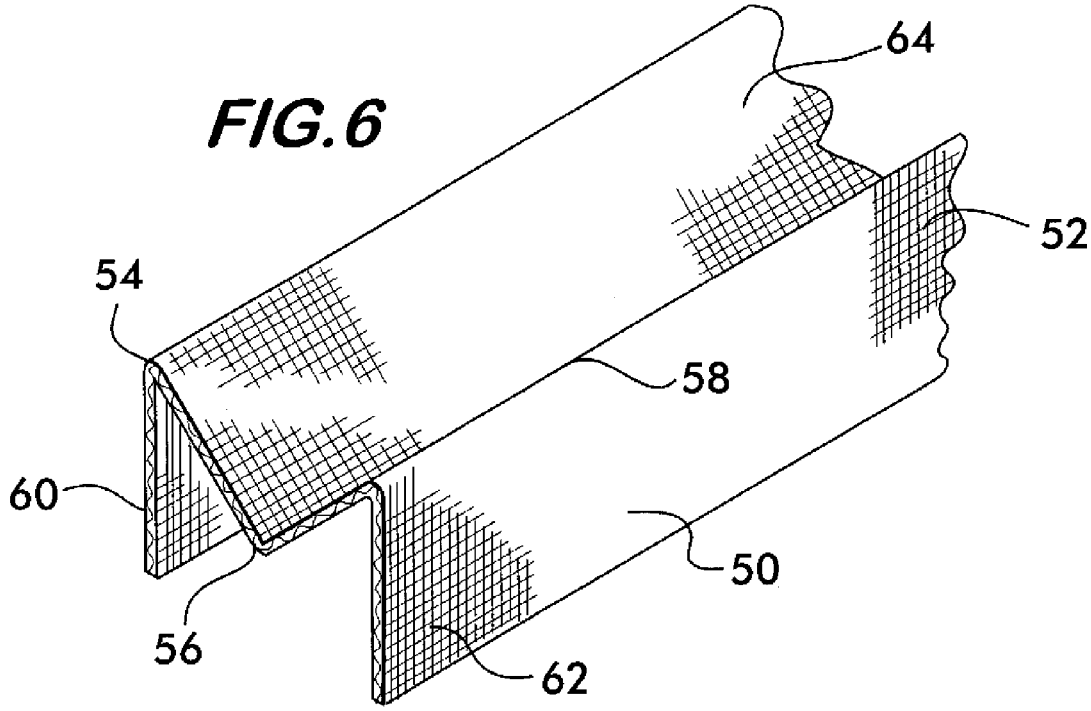
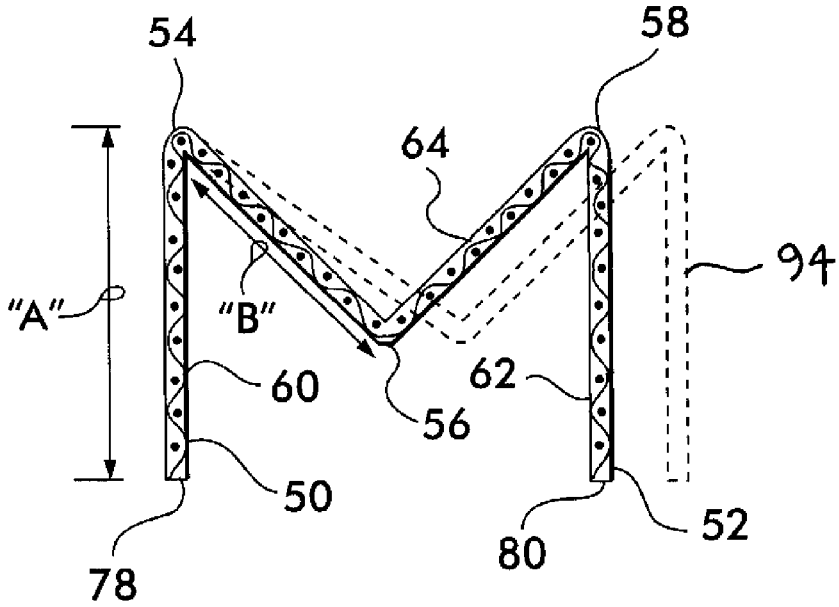
FIG.7

MASONRY CAVITY WALL HAVING A COMPRESSIBLE, EXPANDABLE DEBRIS BLOCKER

CROSS-REFERENCE TO RELATED APPLICATIONS

This application claims the benefit under 35 USC §119(e) of U.S. Provisional Patent Application No. 60/630,390, filed Nov. 23, 2004.

BACKGROUND OF THE INVENTION

The present invention relates to a mortar and debris collection device for use within a cavity wall to prevent the blockage of weep holes at the base of the wall, and more particularly, the present invention relates to a masonry cavity wall assembly including a mortar and debris blocker and to a method of assembling a masonry cavity wall with a mortar and debris blocker.

Masonry cavity wall constructions include inner and outer vertical walls with a space or cavity existing therebetween. The inner wall can be made of a wood sheathing or like material, and the outer wall can be made of bricks, stones, blocks or the like held together by mortar. Weep holes are typically located at the base of the outer wall to permit water to drain from the cavity and to permit the cavity to be ventilated to prevent moisture from accumulating therein.

Excess mortar and other building construction debris often falls within the cavity between the inner and outer walls during construction of the cavity wall. The excess mortar and debris drops to the base of the cavity where it can block weep holes. Thus, some masonry cavity walls have been constructed with mortar and debris collection devices, or so-called "blockers".

Examples of such blockers are provided by U.S. Pat. Nos. 6,684,579 B2 issued to Brunson et al; U.S. Pat. Nos. 6,023,892, Re. 36,676, and 5,230,189 issued to Sourlis; U.S. Pat. No. 5,692,348 issued to Ambrosino; U.S. Pat. No. 6,256,955 issued to Lolley; U.S. Pat. No. 5,598,673 issued to Atkins; and U.S. Pat. No. 5,860,259 issued to Laska, and U.S. Patent Application Nos. 2004/0003558 A1 and 2003/0230035 A1 issued to Collins et al.

While the masonry cavity wall assemblies having mortar and debris blockers and methods of assembling cavity walls disclosed in the above referenced patents may be satisfactory, there continues to be a need for alternatives with respect to the design of such blockers and methods of installation. For instance, the mortar and debris blocker should be capable of being properly installed in a manner requiring only a minium of skill, effort and time. In addition, the blocker should be capable of efficient manufacture from inexpensive materials and should be of a form permitting efficient storage and shipping.

BRIEF SUMMARY OF THE INVENTION

More specifically, the present invention provides a method of assembling a cavity wall with a debris blocker. A base section of a masonry wall is assembled adjacent an inner wall such that a wall cavity is defined therebetween, and a continuous, elongate strip of material is inserted within the wall cavity such that the strip of material is supported on a bottom surface of the wall cavity and forms a debris collection surface a spaced distance above the bottom surface of the wall cavity. The strip of material is an openwork material that permits moisture to drain therethrough and prevents mortar from passing therethrough. After the strip of material is inserted in the cavity, the assembly of an upper section of the masonry wall is completed. Any excess mortar falling into the cavity during the assembly of the upper section of the masonry wall engages and is supported on the debris collection surface and is thereby prevented from blocking weep holes at the bottom of the cavity.

Preferably, the step of inserting the strip of material includes flexing or compressing the strip of material along creases or the like to enable the strip of material to fit within the cavity. Thereafter, the strip of material is permitted to resiliently flex or expand outwardly into engagement with both the inner and masonry walls to form a debris collection surface that bridges the inner and masonry walls above the bottom surface of the wall cavity. As inserted, the strip of material preferably has an M-shaped or inverted U-shaped transverse cross-section.

According to another aspect of the present invention, a masonry cavity wall assembly is provided. The assembly includes a masonry wall, an adjacent inner wall, and a wall cavity extending therebetween above a base surface. An elongate strip of material is located within the wall cavity such that it is supported in a free-standing position on the base surface of the wall cavity. The strip of material provides a debris collection surface a spaced distance above the base surface for collecting excess mortar and debris that falls within the wall cavity and for preventing the mortar and debris from clogging weep holes that are located adjacent the base surface of the cavity wall. The strip of material is an openwork material that permits moisture to drain therethrough and that prevents mortar from passing therethrough.

Preferably, the strip of material has opposite longitudinally-extending side sections, or legs, and a longitudinally-extending central section. One of the side sections extends upright and engages the masonry wall, while the other extends upright and engages the inner wall. The central section extends therebetween and forms the debris collection surface. Preferably, when located within the cavity, the strip of material has an "M"-shaped or inverted "U"-shaped transverse cross-section.

BRIEF DESCRIPTION OF THE DRAWINGS

The features and advantages of the present invention should become apparent from the following description when taken in conjunction with the accompanying drawings, in which:

FIG. 6 is a perspective view of an alternate strip of material for use as a mortar and debris blocker according to the present invention;

FIG. 7 is a transverse cross-section view of the strip of material of FIG. 6;

DETAILED DESCRIPTION OF THE INVENTION

Figure 5:
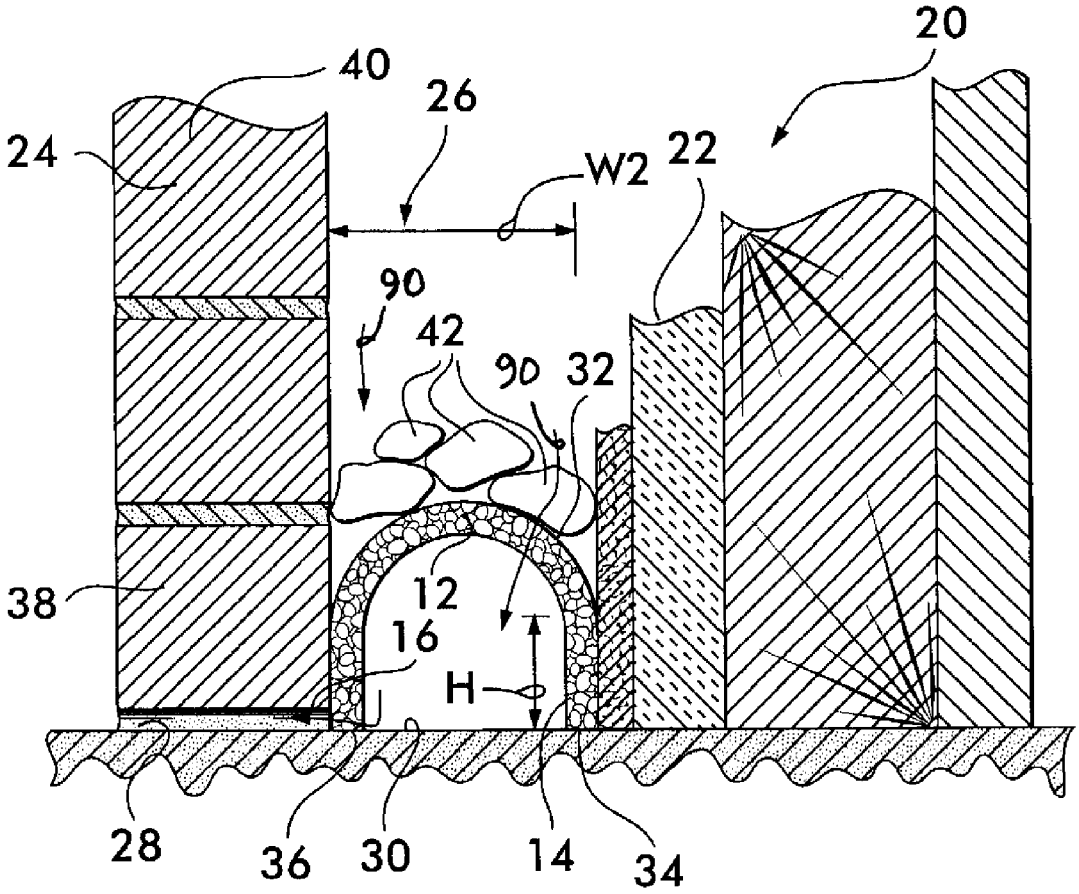
FIG. 5 is a cross-sectional view taken along line 5-5 of FIG. 3.
Figure 9:
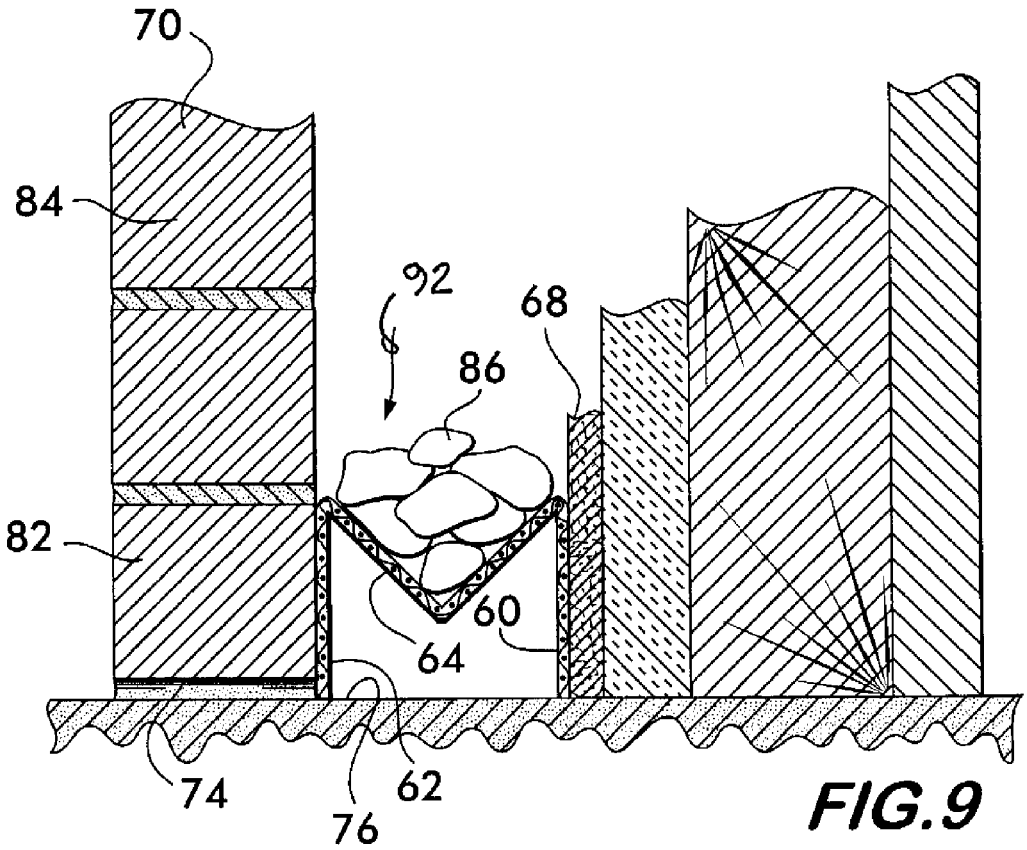
FIG. 9 is a cross-sectional view taken along line 8-8 of FIG. 8.

A mortar and debris blocker according to the present invention is made of an elongate strip of openwork material that is sufficiently dense to support mortar and other construction debris thereon and that has sufficient openings therein to permit liquid, moisture vapor, and air to flow, or drain, therethrough; for example, see the direction of flow shown by arrows 90 in the assembly illustrated in FIG. 5 and arrow 92 illustrated in the assembly of FIG. 9. Thus, the blocker can be used in cavity wall construction to prevent mortar and other construction debris that may fall within a wall cavity from clogging or restricting flow through weep or ventilation openings typically located at the base of such walls. The openings in the material permit water to drain through the blocker to weep holes and permit air flow for evaporation of any moisture accumulated within the wall.

In an first embodiment of the present invention illustrated in FIGS. 1-5, the blocker 10 is provided as a relatively-flat strip of material having a width "W1" (as measured in a flat condition) greater than a width "W2" of the wall cavity in which it is to be installed. The strip of material 10 is sufficiently flexible at least along a longitudinally-extending central section 12 thereof to permit the normally flat strip 10 to be inserted within the cavity in a bowed or inverted U-shape across its width. Thus, a pair of longitudinally-extending side sections, 14 and 16, of the strip 10 engage opposed wall surfaces that define the cavity, and the longitudinally-extending central section 12 forms an upwardly-projecting, debris-collection canopy therebetween that bridges the opposed walls.

The blocker 10 possesses a degree of resiliency such that, when flexed or folded along its longitudinally-extending central section 12, the strip exerts a force to expand to its normal relatively-flat condition. In this way, when flexed and positioned within a wall cavity, the strip 10 automatically expands into engagement with the opposed wall surfaces defining the cavity to ensure that the blocker engages the opposed walls and bridges across the entire width of the cavity throughout the length of the blocker.

Figure 1:
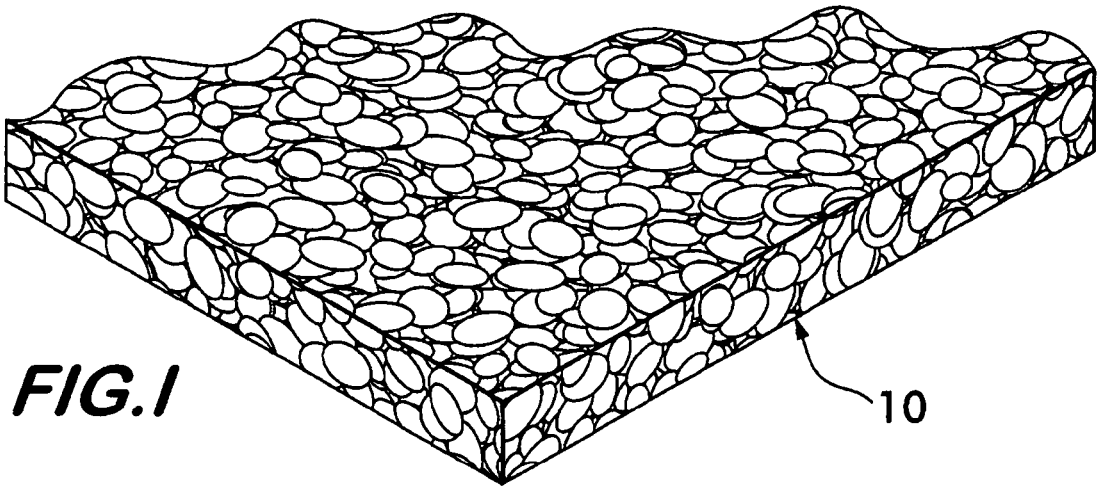
FIG. 1 is a perspective view of a strip of material for use as a mortar and debris blocker according to the present invention.
Figure 2:
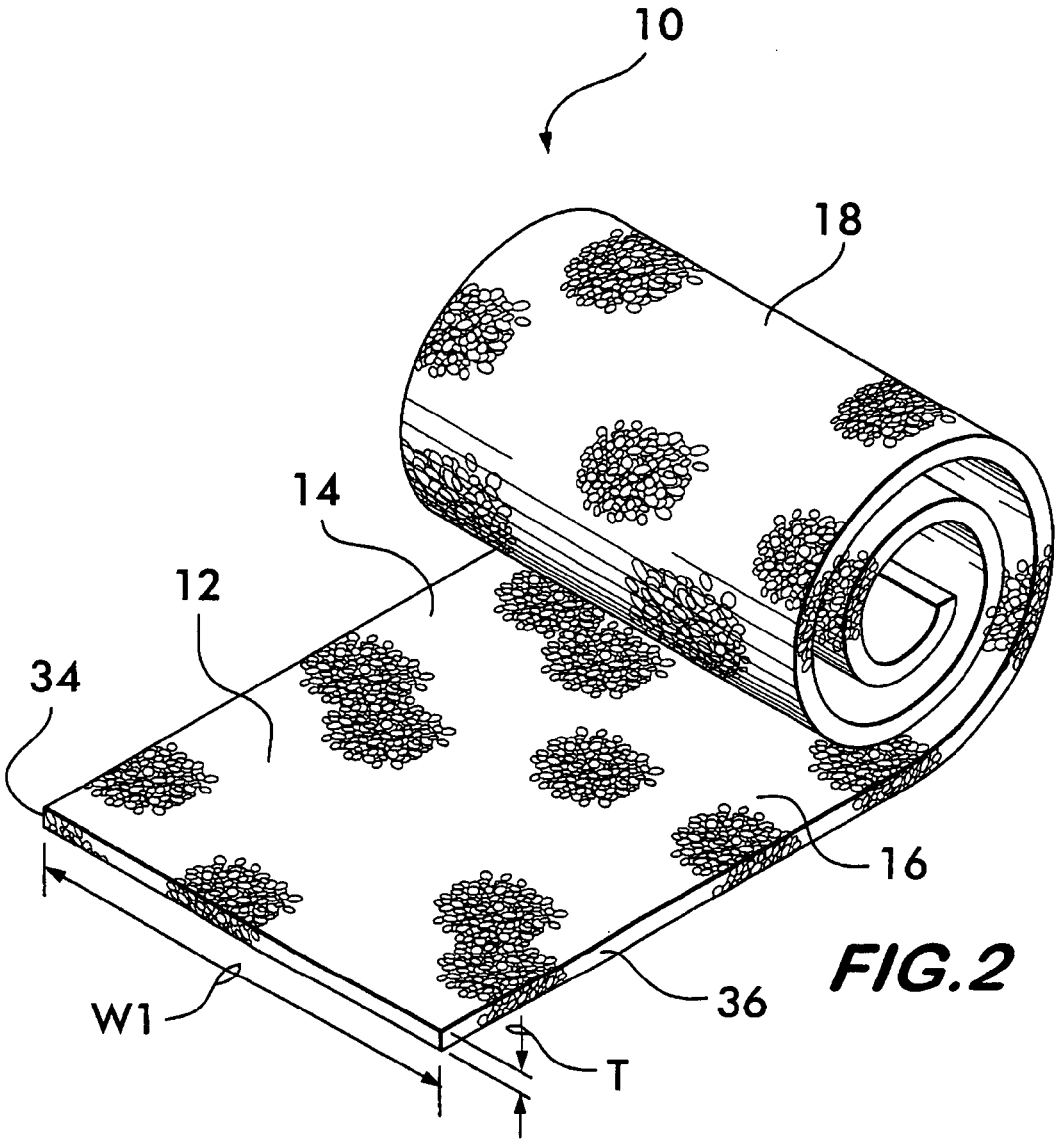
FIG. 2 is a perspective view of the strip of material provided in a spiral roll.

A specific example of an openwork material for the blocker 10 is a porous, closed-cell composite 10 as illustrated in FIGS. 1 and 2 in which closed cell polymer beads are fused together along contacting surfaces thereof. A network of openings extend adjacent non-contacting surfaces of the beads and permit fluids to flow through the composite. The beads can be made, for instance, of polypropylene, polyethylene or like materials. Alternatively, a mat of fibers (not shown), a metal or plastic screen (not shown) or like openwork material can be utilized.

By way of example, and not be way of limitation, the blocker 10 can be provided in strips of any length and is preferably stored and shipped in a spiral roll 18 as illustrated in FIG. 2. The strip 10 can have a width "W1" of about 4 inches to about 16 inches, or more and can have a thickness "T" of about 0.125 inch to about 2 inches, or more.

Figure 3:
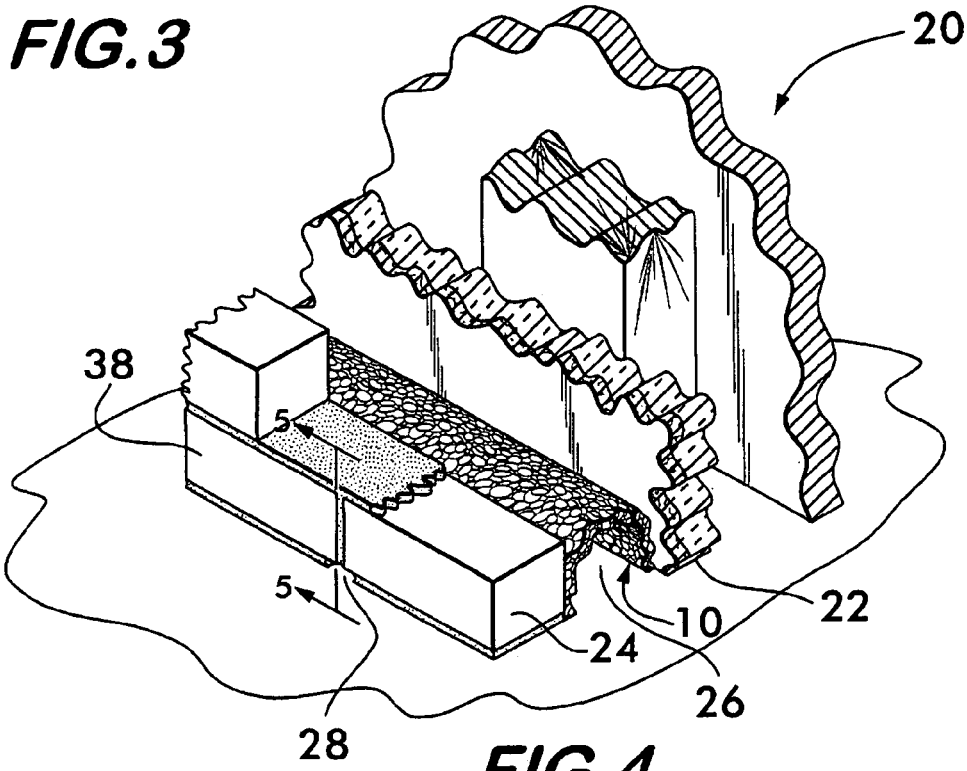
FIG. 3 is a broken-away perspective view of a cavity wall assembly according to the present invention.
Figure 4:
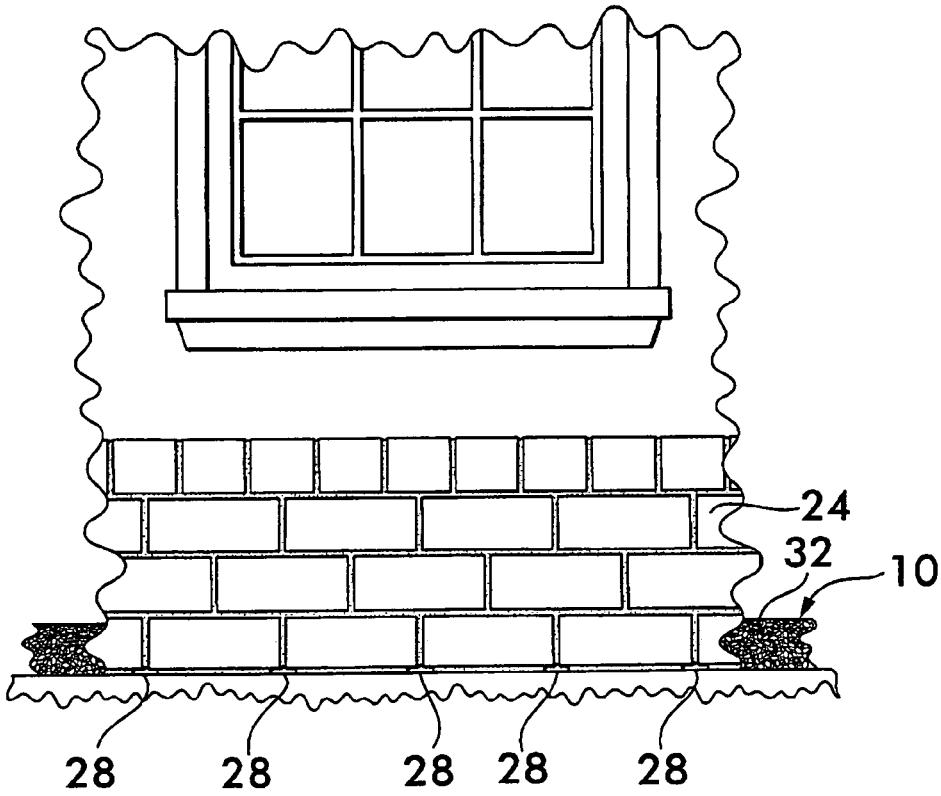
FIG. 4 is a broken-away front elevational view of the cavity wall assembly.

As shown in FIGS. 3-5, a cavity wall assembly 20 includes an inner wall 22 that can be made of wood sheathing, OSB, brick, concrete or like material and that may be covered with housewrap, building paper, felt, insulation or like materials. The assembly also includes an outer wall 24 that is typically made of brick, cement block, stone or like material held together with mortar or the like. The inner and outer walls, 22 and 24, are typically vertical and extend in a parallel, spaced-apart relation such that a cavity 26 is formed therebetween. The cavity 26 typically has a width "W2" of about 2 inches to about 4 inches, but may be greater. Weep holes or like drainage and/or ventilation openings 28 are typically provided through the outer wall 24 adjacent the bottom 30 of the cavity 26 to provide drainage paths (see arrows in FIG. 5) for any moisture that may enter the cavity 26.

A continuous length of the blocker 10 is positioned in a free-standing condition on the bottom 30 of the cavity 26 in an upwardly-bowed, or inverted U-shaped, configuration. In this position, the blocker 10 provides an upwardly-projecting canopy 32 that extends to an elevation above the weep holes 28 and that prevents excess mortar and like debris from reaching the location of the weep holes 28. As best illustrated in FIG. 5, the longitudinally-extending side section 14 of the blocker 10 engages the inner wall 22, the longitudinally-extending side section 16 of the blocker 10 engages the outer wall 24, and the longitudinally-extending central section 12 of the blocker 10 is flexed in a bowed configuration therebetween forming the upwardly-projecting canopy 32. As illustrated, preferably side edges, 34 and 36, of the blocker 10 engage the bottom 30 of the cavity 26, and the side sections, 14 and 16, confront and extend parallel to the walls 22 and 24 for a given height "H". This ensures that the central section 12 of the blocker 10 is positioned and supported above the weep holes 28 and bottom 30 of the cavity 26 and reinforces the canopy structure.

During assembly of the cavity wall 20, the inner wall 22 and a base portion 38 of the outer wall 24 are constructed. The base portion 38 can include, for instance, the lowermost course or lowermost several courses of bricks or the like which is of a height enabling the blocker 10 to be readily positioned by hand in the bottom 28 of the cavity 26. A continuous, elongate strip of blocker 10 is inserted within the cavity 26 to form an upwardly-projecting, hollow canopy 32 therein. The strip 10 can be of a length equal to the length of the cavity 26, and the method of assembly can include providing an elongate strip of blocker 10 in a spiral roll 18, unrolling the blocker 10, and cutting it to the length of the cavity 26.

Preferably, the step of inserting the blocker 10 in the cavity 26 is accomplished by flexing, or folding, the relatively flat strip of blocker 10 along its longitudinally-extending central section 12 so that the blocker 10 fits within the cavity 26. Thereafter, the blocker 10 is permitted to flex into engagement with the inner wall 22 and outer wall 24 due to its resilient nature. Thus, an upwardly projecting canopy 32 is formed in the cavity and extends the length of the cavity. Thereafter, the cavity wall assembly 20 is completed by constructing an upper section 40 of the outer masonry wall 24. Any excess mortar 42 falling into the cavity 26 falls on and is supported by the canopy 32.

FIGS. 6-9 illustrate a second embodiment of the present invention. The blocker 50 is provided as an elongate strip of material 52 that can be folded, bent, or flexed into an "M"shape in transverse cross section (see FIG. 7). Preferably, the material 52 has three longitudinally-extending creases, or fold lines, 54, 56 and 58, permitting the sheet of material 52 to be folded, bent or flexed into the M-shape. The legs 60 and 62 of the M-shaped blocker 50 can be engaged with the opposed wall surfaces of a wall cavity, and a central section 64 of the M-shaped blocker provides a debris collection surface, or trough, that bridges the opposed walls.

Preferably, the blocker 50 possesses a degree of resiliency such that, when flexed or folded along its creases, 54, 56 and/or 58, into a compressed M-shape, the blocker 50 exerts a force to expand outwardly in an accordion manner. For example, see the dashed lines 94 illustrated in FIG. 7 showing the blocker in an expanded condition. In this way, when compressed and positioned within a wall cavity, the M-shaped blocker 50 automatically expands into engagement with the opposed wall surfaces defining the cavity to ensure that the blocker engages the opposed walls and bridges across the entire width of the cavity throughout the length of the blocker. Alternatively, the blocker 50 can be manually expanded and/or compressed into a desired width.

The openwork material 52 for the blocker 50 can be perforated sheet metal, a perforated polymer sheet, a stiff porous foam, a mat of fibers, or the like. By way of example, and not be way of limitation, the material 52 can be a perforated sheet of aluminum that is 4 feet in length by 3 feet in width and that has three serrated fold lines formed along its length. The fold lines can also be formed at desired radius of curvatures to permit ready flexing, or hinging, of the material along the fold lines. The legs 60 and 62 can extend to a height "A" of about 10 inches, and the spacing "B" between creases 54 and 56, and 56 and 58, can be about 8 inches.

Figure 8:
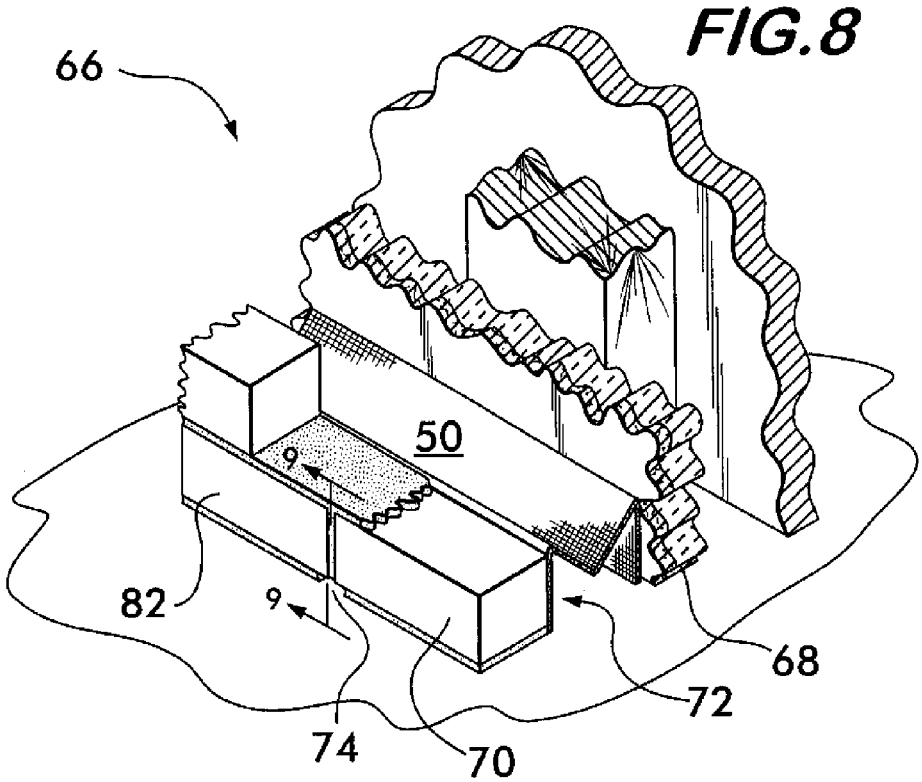
FIG. 8 is a broken-away perspective view of another cavity wall assembly according to the present invention.

As shown in FIGS. 8 and 9, a cavity wall assembly 66 includes an inner wall 68 that can be made of wood sheathing, OSB, brick, concrete or like material and that may be covered with housewrap, building paper, felt, insulation or like materials. The assembly also includes an outer wall 70 that is typically made of brick, cement block, stone or like material held together with mortar or the like. The inner and outer walls, 68 and 70, are typically vertical and extend in a parallel, spaced-apart relation such that a cavity 72 is formed therebetween. The cavity 72 typically has a width of about two inches to about four inches, but may be greater. Weep holes or like drainage and/or ventilation openings 74 are typically provided through the outer wall 70 adjacent the bottom 76 of the cavity 72 to provide drainage paths for any moisture that may enter the cavity.

A continuous length of the M-shaped blocker 50 is positioned in a free-standing condition on the bottom 76 of the cavity 72. In this position, the blocker 50 provides a debris collection surface 64 that extends at an elevation above the weep holes 74 and that prevents excess mortar and like debris from reaching the weep holes 74. As best illustrated in FIG. 9, the longitudinally-extending side section, or leg, 60 of the blocker 50 engages the inner wall 68, the longitudinally-extending side section, or leg, 62 of the blocker 50 engages the outer wall 70, and the longitudinally-extending central section 64 of the blocker 50 provides a debris and mortar collection trough therebetween. The longitudinal-extending edges, or feet, 78 and 80, of the blocker 50 engage the bottom 76 of the cavity 72 in a free-standing manner, and the legs, 60 and 62, confront and extend parallel to the walls 68 and 70. This ensures that the central section 64 of the blocker 50 is positioned and supported above the weep holes 74 and bottom 76 of the cavity 72.

During assembly of the cavity wall 66, the inner wall 68 and a base portion 82 of the outer wall 70 are constructed. The base portion 82 can include, for instance, the lowermost course or lowermost several courses of bricks or the like which is of a height enabling the blocker 50 to be readily positioned by hand in the bottom 76 of the cavity 72. A continuous, elongate strip of blocker 50 is inserted within the cavity 72 to form a debris collection surface 64. Preferably, the step of inserting the blocker 50 in the cavity 72 is accomplished by compressing the M-shaped blocker 50 in an accordion manner so that the blocker 50 easily fits within the cavity 72. Thereafter, the blocker 50 is manually or automatically expanded into engagement with the inner wall 68 and outer wall 70. Thus, a debris collection surface, or trough 64 can be formed in the cavity 72 throughout the length of the cavity. Thereafter, the cavity wall assembly 66 is completed by constructing an upper section 84 of the outer masonry wall 70. Any excess mortar 86 falling into the cavity 72 falls onto and is supported by the debris collection surface 64.

The above-described mortar and debris blockers are easy to install, inexpensive to manufacture, and provide the required mortar blocking function while permitting fluids to drain or flow therethrough.

While preferred blockers, assemblies and methods have been described in detail, various modifications, alterations, and changes may be made without departing from the spirit and scope of the blockers, assemblies and methods according to the present invention as defined in the appended claims.

We claim:

1. A masonry cavity wall assembly, comprising:

an exterior masonry wall adjacent an inner wall defining a wall cavity therebetween above a base surface; and a free-standing elongate strip of material supported on said base surface within said wall cavity forming a debris collection surface a spaced distance above said base surface for supporting thereon excess mortar and debris falling within said wall cavity;

said strip of material having a substantially M-shaped transverse cross-section and being an openwork material that permits moisture to drain therethrough and prevents mortar from passing therethrough;

said M-shaped strip of material having a spaced-apart pair of longitudinally-extending, substantially-upright legs interconnected only by a longitudinally-extending central section extending from upper ends of said legs, one of said legs engaging said masonry wall and an opposite one of said legs engaging said inner wall, and said central section extending therebetween and forming said debris collection surface as a V-shaped trough;

said strip of material having three longitudinally-extending, flexible creases enabling said strip of material to have said M-shaped transverse cross section, a first one of said creases being formed at an interconnection of said one of said legs with said central section, a second one of said creases being formed at an interconnection of said opposite one of said legs with said central section, and a third one of said creases being formed entirely in said central section at a location intermediate of said legs to enable said central section to form said V-shaped trough; and said three flexible creases extending parallel to each other and parallel to said exterior masonry wall and said inner wall enabling said M-shaped strip of material to be compressible in an accordion manner about said creases so that it can be positioned within said wall cavity in a compressed condition and expandable in an accordion manner about said creases so that it can expand into engagement with said inner and masonry walls.

2. A masonry cavity wall assembly according to claim 1, wherein said strip of openwork material is selected from a group consisting of a perforated sheet of metal, a perforated sheet of polymer, and a rigid porous foam material.

3. A masonry cavity wall assembly according to claim 1, wherein said strip of material is selected from a group consisting of a porous closed cell composite and a mat of fibers.

4. A masonry cavity wall assembly according to claim 1, wherein said strip of openwork material consists of a single layer of a single material.

* * * * *